US009999331B2

(12) United States Patent
Genn

(10) Patent No.: US 9,999,331 B2
(45) Date of Patent: Jun. 19, 2018

(54) DOMESTIC CLEANING APPLIANCE

(75) Inventor: Stuart Lloyd Genn, Wiltshire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 628 days.

(21) Appl. No.: 11/632,821

(22) PCT Filed: Jul. 8, 2005

(86) PCT No.: PCT/GB2005/002691
§ 371 (c)(1),
(2), (4) Date: Jan. 19, 2007

(87) PCT Pub. No.: WO2006/008451
PCT Pub. Date: Jan. 26, 2006

(65) Prior Publication Data

US 2008/0083085 A1 Apr. 10, 2008

(30) Foreign Application Priority Data

Jul. 23, 2004 (GB) ..... 0416476.0

(51) Int. Cl.
*A47L 9/16* (2006.01)
*A47L 5/28* (2006.01)
*A47L 9/32* (2006.01)

(52) U.S. Cl.
CPC ..... *A47L 9/1691* (2013.01); *A47L 5/28* (2013.01); *A47L 9/32* (2013.01)

(58) Field of Classification Search
CPC . A47L 9/20; A47L 9/1691; A47L 5/28; A47L 9/1683; A47L 9/1666; A47L 9/1608
USPC ..... 15/352, 410, 327.1, 327.2, 327.6, 327.7, 15/350, 351; 55/337, 472, 482, DIG. 3, 55/459.1
See application file for complete search history.

(56) References Cited

U.S. PATENT DOCUMENTS

| | | | | |
|---|---|---|---|---|
| 4,566,884 | A | 1/1986 | Jones et al. | |
| 6,735,818 | B2 | 5/2004 | Hamada et al. | |
| 6,818,032 | B2 * | 11/2004 | Bilek et al. | 55/337 |
| 7,377,008 | B2 * | 5/2008 | Park et al. | 15/329 |
| 2002/0108208 | A1 * | 8/2002 | Hamada et al. | 15/352 |

(Continued)

FOREIGN PATENT DOCUMENTS

| | | |
|---|---|---|
| GB | 877883 | 9/1961 |
| GB | 2365325 | 2/2002 |

(Continued)

OTHER PUBLICATIONS

Genn, U.S. Office Action dated Feb. 1, 2012, directed towards U.S. Appl. No. 12/376,741; 10 pages.

(Continued)

*Primary Examiner* — Robert Scruggs
(74) *Attorney, Agent, or Firm* — Morrison & Foerster LLP

(57) ABSTRACT

A domestic appliance such as a cyclonic vacuum cleaner includes a component such as separating apparatus, carried by a chassis. A catch is provided and is operable to release the component from the chassis. The component and the chassis are able to move slightly with respect to each other. When the appliance is lifted, lugs on the separating apparatus move into slots on the chassis so as to inhibit release of the catch when the appliance is lifted. Thus, accidental release of the separating apparatus from the chassis is avoided.

23 Claims, 6 Drawing Sheets

(56) References Cited

U.S. PATENT DOCUMENTS

| | | | | |
|---|---|---|---|---|
| 2002/0162188 | A1* | 11/2002 | Harmen | 15/353 |
| 2003/0005547 | A1 | 1/2003 | Bone | |
| 2004/0205928 | A1* | 10/2004 | Alford et al. | 15/352 |
| 2004/0261213 | A1* | 12/2004 | Park et al. | 15/328 |
| 2010/0071153 | A1 | 3/2010 | Genn | |

FOREIGN PATENT DOCUMENTS

| | | | |
|---|---|---|---|
| GB | 2383527 | | 7/2003 |
| GB | 2403133 | | 12/2004 |
| GB | 2416483 | | 2/2006 |
| JP | 52-126069 | | 10/1977 |
| JP | S52-126069 | | 10/1977 |
| JP | 57-22573 | | 5/1982 |
| JP | 2002-233484 | | 8/2002 |
| JP | 2003-479 | | 1/2003 |
| JP | 2005-95664 | | 4/2005 |
| KR | 2002-0066958 | | 8/2002 |
| WO | WO 00/38255 | | 6/2000 |
| WO | WO 02/067754 | A1 | 9/2002 |
| WO | WO-2004/049887 | | 6/2004 |
| WO | WO-2006/008451 | | 1/2006 |

OTHER PUBLICATIONS

Genn, U.S. Office Action dated Oct. 17, 2012, directed to U.S. Appl. No. 12/376,741; 10 pages.

* cited by examiner

DOMESTIC CLEANING APPLIANCE

REFERENCE TO RELATED APPLICATIONS

This application is a national stage application under 35 USC 371 of International Application No. PCT/GB2005/002691, filed Jul. 8, 2005, which claims the priority of United Kingdom Application No. 0416476.0, filed Jul. 23, 2004, the contents of both of which prior applications are incorporated herein by reference.

FIELD OF THE INVENTION

The invention relates to a domestic appliance, such as a vacuum cleaner.

BACKGROUND OF THE INVENTION

Vacuum cleaners which separate dirt and dust from an airflow without the use of a filter bag, so-called bagless vacuum cleaners, are becoming increasingly popular. Most bagless cleaners use cyclonic or centrifugal separation to spin dirt and dust from the airflow. By avoiding the use of a filter bag as the primary form of separation, it has been found possible to maintain a consistently high level of suction, even as the collecting chamber fills with dirt and dust.

In a typical cyclonic vacuum cleaner, an airflow in which dirt and dust is entrained enters a first cyclonic separator via a tangential inlet. The inlet causes the airflow to follow a spiral or helical path within a collection chamber so that dirt and dust is separated from the airflow. Relatively clean air passes out of the chamber whilst the separated dirt and dust is collected therein. In some cyclonic vacuum cleaners, the airflow is then passed to a second cyclone separator which is capable of separating finer dirt and dust than the upstream cyclone. The airflow is thereby cleaned to a greater degree so that, by the time the airflow exits the cyclonic separating apparatus, the airflow is almost completely free of dirt and dust particles. The dirt and dust is left behind inside the collecting chamber.

When the collecting chamber becomes full, a user typically removes the collecting chamber from the chassis of the machine, carries the chamber to a dust bin or refuse sack and empties the contents of the chamber into the bin or sack. The chamber may be emptied by inverting it. Alternatively, a manually operable catch may release the base portion of the chamber so that the dirt and dust falls out of the chamber into the bin or sack.

Typically, a handle is provided to enable the user easily to carry the collecting chamber to the bin or sack for emptying. Conveniently, the same handle may be employed by the user for lifting the vacuum cleaner in its entirety when the collecting chamber is attached to the chassis, to facilitate carrying the cleaner between different locations.

A problem which may be encountered with such appliances is that, when the user is carrying the appliance by means of the handle, he may accidentally release the catch holding the collecting chamber to the chassis. Thus, the chassis may be released completely from the chamber and may fall to the ground. This may cause damage to the chassis as well as being an inconvenience to the user.

SUMMARY OF THE INVENTION

The invention provides a domestic appliance comprising a component carried by a chassis and a catch operable to release the component from the chassis, wherein a portion of the catch on the component is arranged to move with respect to another portion of the catch on the chassis when the appliance is lifted, so as to inhibit release of the catch.

The provision of a catch that is not releasable when the appliance is lifted prevents the chassis and the component from being released accidentally from each other.

Advantageously, one portion of the catch comprises a lug, the other portion comprising a slot, the lug and slot being arranged to engage each other when the appliance is lifted. The lug and slot are advantageously arranged automatically to disengage from each other when the appliance is placed on a surface, such as a floor surface.

The catch may also comprise a pivotable member on one of the component and the chassis arranged to releasably engage in a lip on the other of the component and the chassis. The pivotable member may be releasable from the lip against the force of resilient means.

The invention is particularly applicable to vacuum cleaners. The invention prevents a user from releasing the separating apparatus comprising a collecting chamber employed for collecting dirt and dust from the chassis when the user is carrying the vacuum cleaner.

A handle may be provided to enable the user to carry the appliance. When the invention is applied to a vacuum cleaner having separating apparatus, this handle may also be the handle provided for carrying the separating apparatus when it is removed from the chassis.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 1:
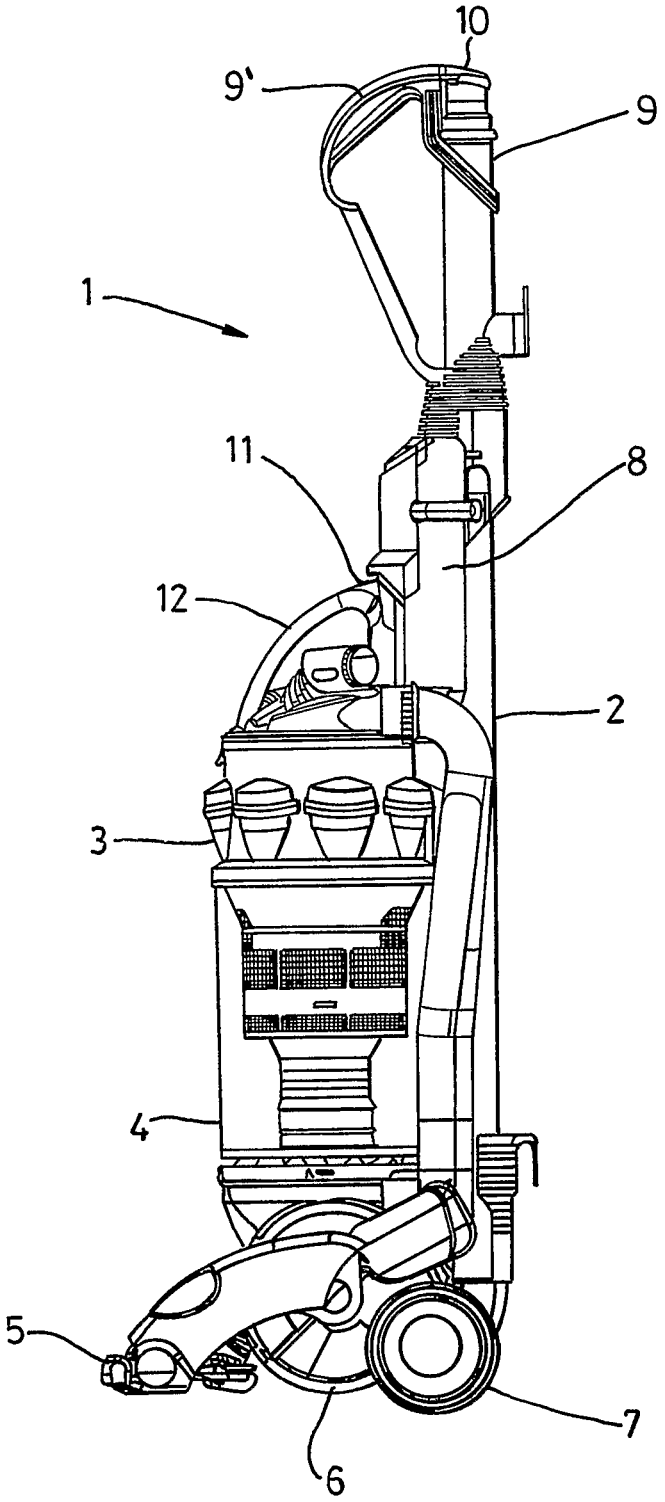
FIG. 1 is a side view of a domestic appliance constructed according to the invention in the form of an upright vacuum cleaner.
Figure 2:
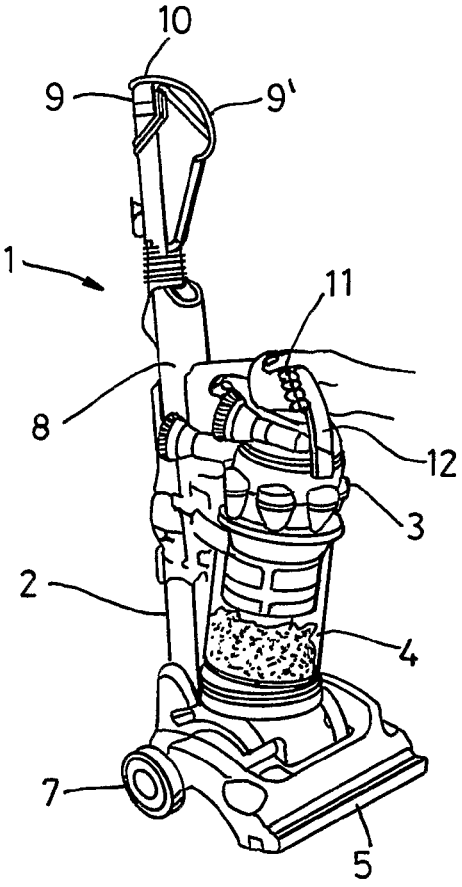
FIG. 2 is perspective view of the cleaner of FIG. 2, showing release of the separation apparatus.
Figure 3:
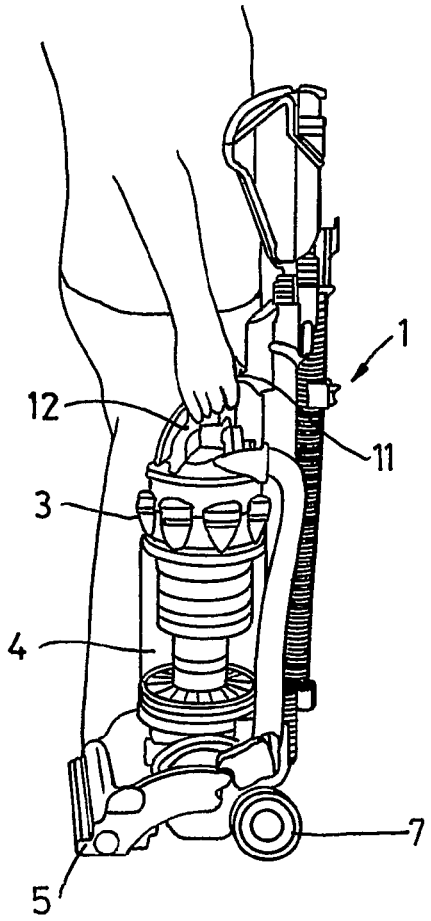
FIG. 3 is a side view of the cleaner of FIGS. 1 and 2 being carried by a user.

Referring to FIG. 1, an upright vacuum cleaner indicated generally by the reference numeral 1 comprises a main chassis 2 which supports dirt and dust separation apparatus 3 incorporating a collecting chamber 4. The lower part of the vacuum cleaner 1 comprises a cleaner head 5 for engaging with the floor surface. The cleaner head 5 has a downwardly facing suction inlet and a brush bar (not shown), mounted in the mouth of the inlet, for agitating the floor surface. The cleaner head 5 is pivotably mounted to a motor housing 6, which houses the motor and fan of the cleaner 1. Support wheels 7 are mounted to either side of the motor housing 6 for supporting the cleaner 1 and allowing movement across a floor surface.

A spine 8 of the chassis 2 extends upwardly from the motor housing 6 to provide support for the components of the cleaner 1. A cleaning wand 9 having a second dirty air inlet 10 is connected by way of a hose (not shown) to the chassis 2 at the base of the spine 8. The wand 9 is releasable from the spine 8 so as to allow a user to carry out above-the-floor cleaning and cleaning in places which are inaccessible by the main cleaning head 5. When the wand 9 is fixed to the spine 8, the wand forms the handle of the cleaner 1. A hand grip 9' at the remote end of the wand 9 allows a user to manoeuvre the cleaner 1.

In the embodiment shown, the dirt- and dust-separating apparatus 3 comprises a cyclonic arrangement but this could readily be replaced by a filter, a bag or a combination of different known separation devices.

In normal upright use, the vacuum cleaner 1 is maneuvered over the floor surface to be cleaned whilst the motor causes dirty air to be sucked into the cleaner 1 via the cleaner head 5. The dirty air is passed to the dirt- and dust-separating apparatus 3 where the dirt and dust is extracted and clean air is expelled to the atmosphere.

Dirt and dust is collected in the collecting chamber 4 of the separating apparatus 3 and needs to be emptied periodically when it is full. Thus, the separating apparatus 3 is releasable from the main chassis 2. A manually releasable catch 11 is provided on the spine 8 of the chassis 2 and is arranged to locate the separating apparatus 3, including the collection chamber 4, on the appliance. The user of the vacuum cleaner 1 releases the catch 11 and removes the separating apparatus 3 by means of a handle 12 provided on the upper portion of the separating apparatus. The user then carries the separating apparatus 3 by means of the handle 12 to a refuse bin or sack for emptying. The collection chamber 4 may be emptied by releasing it from the separating apparatus 3 and inverting it over the bin or sack. Alternatively, the collection chamber 4 may have a moveable base portion that can be released, by means of a further manually releasable catch, to allow dirt and dust to fall from the bottom of the collection chamber.

The handle 12 on the separating apparatus 3 also serves to allow the user to lift and carry the appliance as a whole, as shown in Figure. When the user does this, his hand is close to the catch 11 for releasing the separating apparatus 3 from the chassis 2. With conventional vacuum cleaners, there has been a risk that the user may accidentally release the catch whilst carrying the appliance.

Figure 4A:
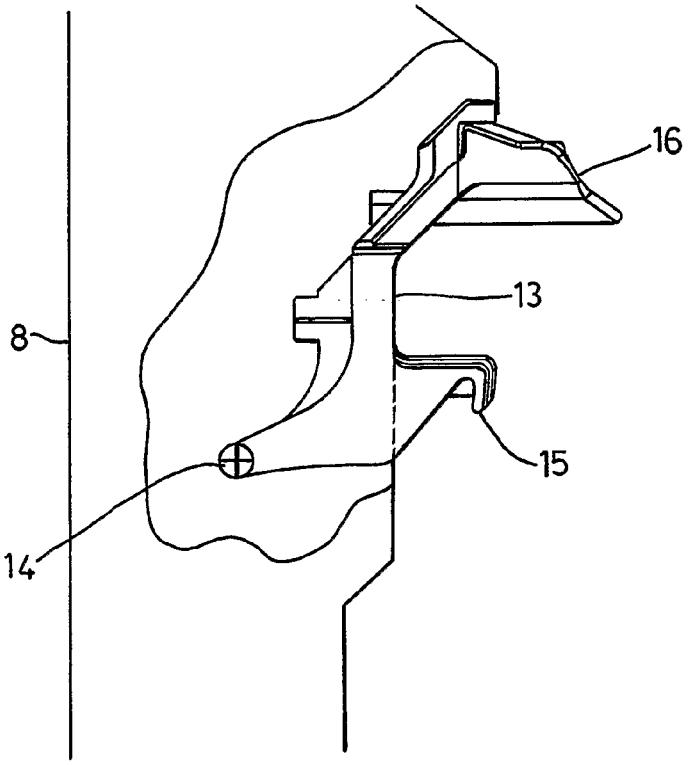
FIG. 4*a* is a partly cut-away side view of part of a catch on the cleaner in a first position.
Figure 4B:
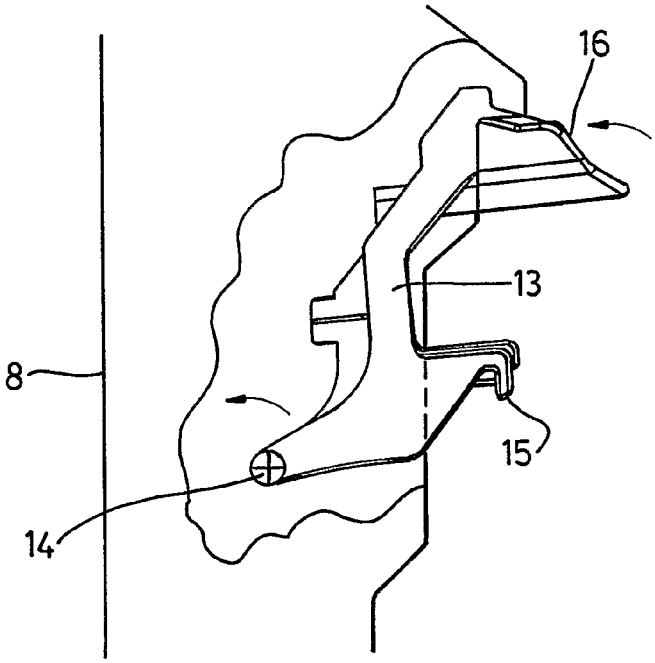
FIG. 4*b* is a partly cut-away side view of the part of a catch of FIG. 4*a* in a second position.

The catch 11 of the vacuum cleaner constructed according to the invention is shown in FIGS. 4 to 6 inclusive. FIGS. 4*a* and 4*b* illustrate the part of the catch 11 located on the spine 8. The catch 11 comprises a main catch member 13 having a pivot 14 on its lower portion to enable it to be pivotably connected to the spine 8. A projecting portion 15 projects away from the spine 8 and then downwardly and is located above the pivot 14. The upper portion of the main catch member 13 comprises a user-operable button 16. When the user pushes the button 16, the main catch member 13 pivots away from the user, towards the spine 8, and the projecting portion 15 of the main catch member is elevated.

Figure 5A:
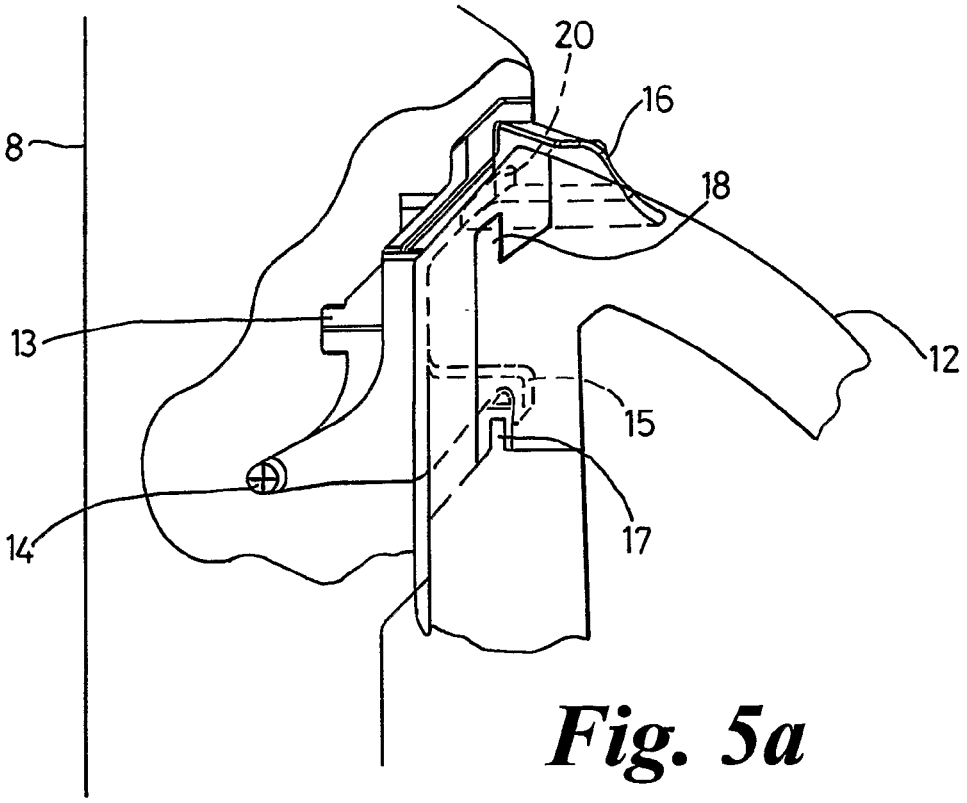
FIG. 5*a* is a partly cut-away side view of the catch on the cleaner in the first position.
Figure 5B:
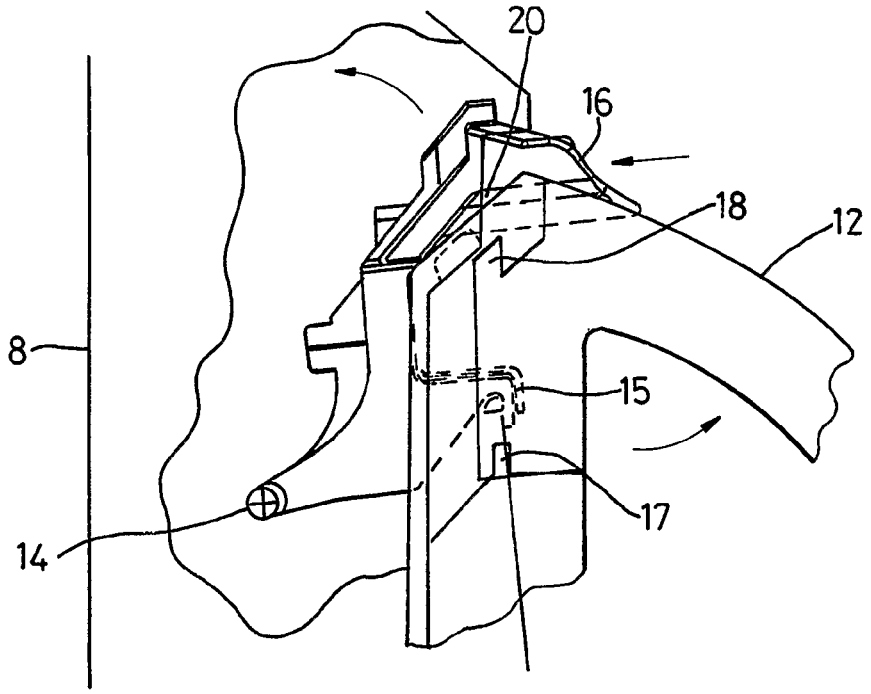
FIG. 5*b* is a partly cut-away side view of the catch on the cleaner in the second position.

FIGS. 5*a* and 5*b* show the complete catch 11, the remaining parts of the catch being located on the handle 12 of the separating apparatus 3. Features of the catch located behind the handle 12 are shown in broken lines in these drawings. FIG. 5*a* shows the catch 11 in its closed position, with the separating apparatus 3 being attached to the chassis 2. The projecting portion 15 of the main catch member 13 is arranged to engage with a lip 17 on the handle 12 of the separating apparatus 3. When the user wishes to release the separating apparatus 3, he pushes against the button 16. This causes the main catch member 13 to move pivotably towards the spine 8 until the projecting portion 15 is clear of the lip 17 on the handle 12. Thus, the catch 11 is released and the separating apparatus 3 is removable as shown in FIG. 5*b*.

When the user wishes to re-attach the separating apparatus 3, he simply pushes the separating apparatus 3 back into position on the chassis 2. As he does so, the pivotable member 13 is pushed backwards until it clears the lip 17 on the handle 12. A spring or other resilient means (not shown) then returns the main catch member 13 to its upright position, with the projecting portion 15 engaging in the lip 17 on the handle 12. Thus, the separating apparatus 3 is secured to the chassis 2.

In accordance with the invention, the catch is arranged so as to allow relative movement between the separating apparatus 3 and the chassis 2 in such a manner that, when the appliance 1 is lifted by the user by means of the handle 12, the catch 11 engages in a position that inhibits its release. To this end, the catch 11 further comprises lugs 18, 19 provided on the handle 12, one (18) of which is visible in FIGS. 5*a*, 5*b*, and 6*a*, both lugs being shown in FIGS. 5*c* and 6*b*. The lugs 18, 19 are located on the inner wall of the handle 12, on either side of the portion that sits against the spine 8 when the separating apparatus 3 is held onto the chassis 2. The lugs 18, 19 project upwardly, but not beyond the upper surface of the handle 12. This feature prevents the lugs being accidentally damaged in use.

Figure 5C:
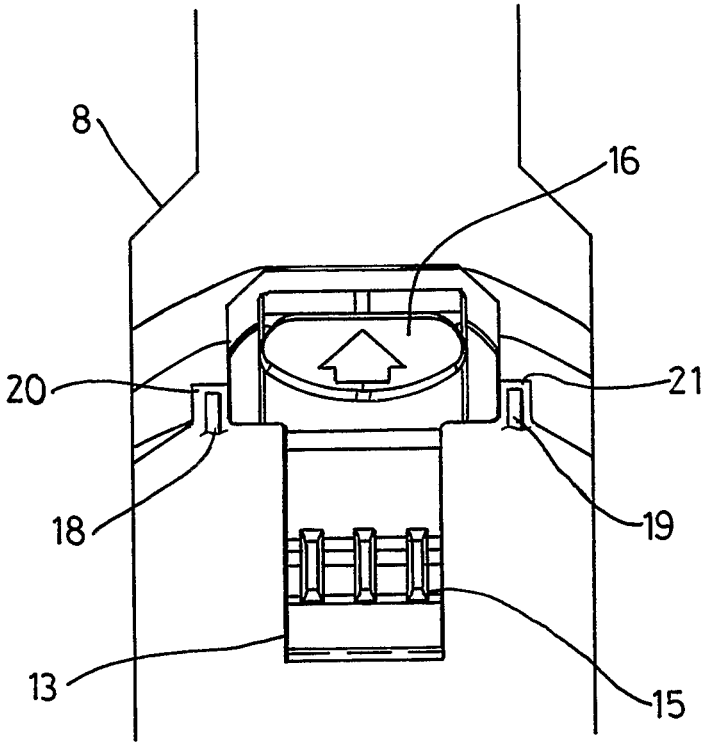
FIG. 5*c* is a front view of part of the catch in the first position.
Figure 6A:
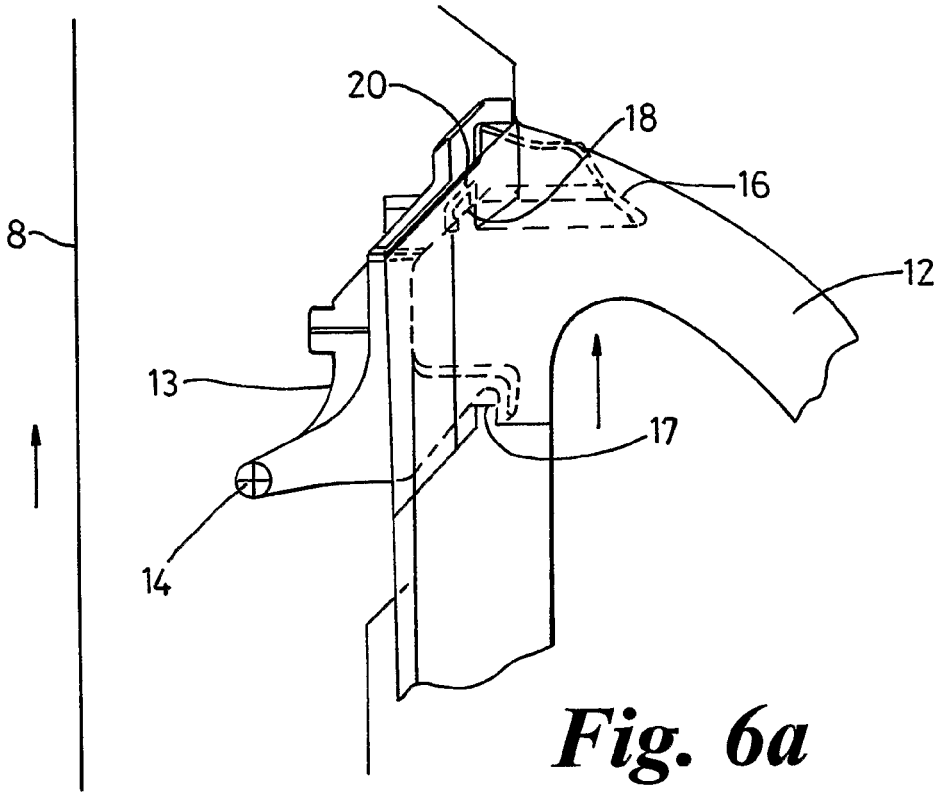
FIG. 6*a* is a partly cut-away side view of the catch of FIG. 5 in a third position.
Figure 6B:
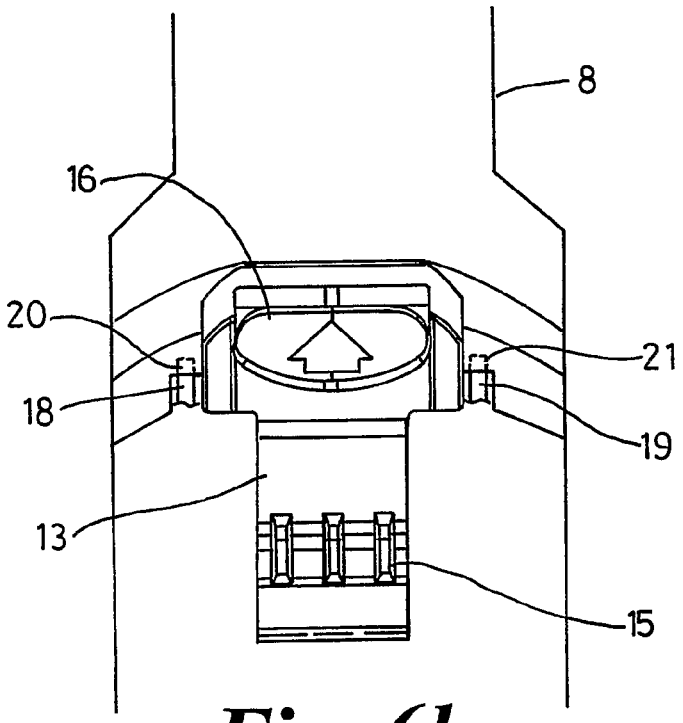
FIG. 6*b* is a front view of part of the catch in the third position.

The catch 11 further comprises slots 20, 21 on the spine 8 of the chassis 2, one (20) of which is shown in FIGS. 5*a*, 5*b* and 6*a*, both being visible in FIGS. 5*c* and 6*b*. FIGS. 5*c* and 6*a* are front views showing most of the features of the catch on the chassis, with only the lugs 18, 19 on the handle being shown for clarity. The slots 20, 21 in the spine are located directly above the lugs 18, 19 and the lugs are dimensioned so as to engage in the slots.

With reference to FIGS. 6*a* and 6*b*, the separating apparatus 3 and chassis 2 are arranged so as to permit a limited amount of relative movement between them. When the user applies a lifting force to the appliance 1 by lifting the handle 12, the separating apparatus 3 is able to move slightly upwardly with respect to the chassis 2 as the appliance is lifted off the ground. Therefore, the portion of the catch 11 located on the handle 12 of the separating apparatus 3 moves upwardly with respect to the portion of the catch 11 located on the spine 8 of the chassis 2. Thus, the lugs 18, 19 on the handle 12 move up into the slots 20, 21 provided on the chassis 2. If the user accidentally pushes the button 16, the main catch member 13 may pivot so as to release the lip 17 from the projecting portion 15, but the catch cannot release the chassis from the separating apparatus because they are held together by the lugs 18, 19 engaged in the respective slots 20, 21.

When the user puts the appliance back down on a floor surface, the components of the catch 11 occupy their normal positions as shown in FIG. 5, with the lugs 18, 19 being free of the slots 20, 21, so that the separating apparatus 3 is once again releasable from the chassis 2.

Of course, variations may be made without departing from the scope of the invention. For example, extra pairs of lugs and slots may be provided to give extra security to the catch to prevent accidental release. The mechanism of the catch may be reversed, so that slots on the handle are arranged to move upwardly when the appliance is lifted and engage downwardly-projecting lugs on the chassis.

The handle for lifting the appliance need not be the same as that provided for carrying the separating apparatus. A separate handle or hand-grip may be provided. The handle for lifting the appliance may be provided on the chassis, in which case upwardly-projecting lugs may be provided on the chassis and arranged to engage in slots on the separating apparatus. Alternatively, downwardly-projecting lugs on the separating apparatus may be arranged to engage in slots on the chassis as the chassis is lifted by the handle.

The catch of the invention may be provided to locate other components on the chassis, so that those components are not releasable whilst the appliance is being carried. The main pivotable member of the catch may be carried by the or each component, arranged to engage with a lip on the chassis.

The lugs may be arranged to locate in slots behind the user-operable button, so as to prevent the button from being depressed. This provides an indication to the user that the catch is inoperable while the appliance is lifted.

Although the invention has been described with reference to an upright vacuum cleaner, it is equally applicable to cylinder cleaners and other appliances that may be carried by a user. For example, a lawn mower may be provided with a chassis and a chamber for collecting grass clippings produced by the mower. The invention may be employed to prevent the collecting chamber from being released when the user is carrying the lawn mower. The invention may also be applied to, for example, other surface-treating appliances, such as those that apply polish or paint to a surface.

The invention claimed is:

1. A domestic appliance comprising:

a component carried by a chassis, the component comprising a carrying handle; and a catch operable to release the component from the chassis, wherein a portion of the catch on the component is configured to move with respect to another portion of the catch on the chassis in response to the appliance being lifted by the carrying handle, so as to prohibit operation of the catch to release the component from the chassis.

2. An appliance as claimed in claim 1, wherein the portion of the catch on the component comprises a first lug or a first slot, and the another portion of the catch on the chassis comprises a corresponding first slot or a corresponding first lug configured so as to engage the portion of the catch provided on the component in response to the appliance being lifted.

3. An appliance as claimed in claim 2, further comprising a second lug and a second slot arranged to engage each other in response to the appliance being lifted so as to prohibit operation of the catch to release the component from the chassis.

4. An appliance as claimed in claim 3, wherein the second lug is provided on the component and the second slot is provided on the chassis.

5. An appliance as claimed in claim 3, wherein the first or second lug and slot are configured so as to disengage from each other in response to the appliance being placed on a surface.

6. An appliance as claimed in claim 3, wherein the second lug and slot are configured so as to disengage from each other in response to the appliance being placed on a surface.

7. An appliance as claimed in claim 2, wherein the first lug and the first slot are configured so as to disengage from each other in response to the appliance being placed on a surface.

8. An appliance as claimed in claim 7, wherein the first lug is provided on the component and the first slot is provided on the chassis.

9. An appliance as claimed in claim 8, wherein the catch comprises a pivotable member on one of the component and the chassis configured so as to releasably engage in a lip on the other of the component and the chassis.

10. An appliance as claimed in claim 9, wherein the pivotable member includes a manually operable button for releasing the catch.

11. An appliance as claimed in claim 9 or 10, wherein the pivotable member releasably engages the lip against a force of a resilient member.

12. An appliance as claimed in claim 2, wherein the catch comprises a pivotable member on one of the component and the chassis configured so as to releasably engage in a lip on the other of the component and the chassis.

13. An appliance as claimed in claim 12, wherein the pivotable member includes a manually operable button for releasing the catch.

14. An appliance as claimed in claim 12 or 13, wherein the pivotable member releasably engages the lip against a force of a resilient member.

15. An appliance as claimed in claim 2, further comprising a handle for carrying the appliance.

16. An appliance as claimed in claim 2, in which the component comprises a separating apparatus for separating dirt and dust from an airflow.

17. An appliance as claimed in claim 16, wherein the separating apparatus further comprises a chamber for collecting the dirt and dust.

18. An appliance as claimed in claim 16 or 17, further comprising a handle for carrying the appliance when the separating apparatus is attached to the chassis and for carrying the separating apparatus when it is released from the chassis.

19. A cyclonic vacuum cleaner, comprising the appliance of claim 18.

20. A cyclonic vacuum cleaner, comprising the appliance of claim 2, 16 or 17.

21. A floor cleaning appliance comprising:

a chassis, a collection bin having a handle;

a catch to releasably secure the collection bin to the chassis;

a release actuator, to disengage the catch and release the collection bin from the chassis; and a locking part to prevent operation of the catch to release the collection bin from the chassis, and to thereby prevent the release actuator from disengaging the catch, in response to the floor cleaning appliance being lifted by the handle.

22. The floor cleaning appliance of claim 21, wherein the locking part prevents the release actuator from disengaging the catch by preventing movement of the release actuator.

23. A floor cleaning appliance comprising:

a chassis;

a collection bin carried by the chassis, the collection bin comprising a carrying handle; and a catch to secure the collection bin to the chassis, the catch comprising a projecting portion biased to engage a lip to secure the collection bin to the chassis, the catch further comprising a button operable to move the projecting portion away from the lip, to release the collection bin from the chassis, the bin further comprising a first restraining portion configured to engage a second restraining portion of the chassis in response to the appliance being lifted by the carrying handle of the collection bin, to prevent operation of the button on the catch to release the collection bin from the chassis.

* * * * *